US007241176B2

(12) United States Patent
Wang

(10) Patent No.: US 7,241,176 B2
(45) Date of Patent: Jul. 10, 2007

(54) MULTIFUNCTIONAL POWER JACK

(76) Inventor: Kin-Sun Wang, 3F.-1, 447, Sec. 2, Bade Rd. Songshan District, Taipei City 105 (TW)

( * ) Notice: Subject to any disclaimer, the term of this patent is extended or adjusted under 35 U.S.C. 154(b) by 0 days.

(21) Appl. No.: 11/361,098

(22) Filed: Feb. 23, 2006

(65) Prior Publication Data

US 2007/0074058 A1 Mar. 29, 2007

(51) Int. Cl.
*H01R 33/945* (2006.01)
*H01R 13/66* (2006.01)

(52) U.S. Cl. ..... 439/620.21

(58) Field of Classification Search ..... 439/535, 439/650, 620.09, 620.31, 620.21
See application file for complete search history.

(56) References Cited

U.S. PATENT DOCUMENTS 4,861,286 A * 8/1989 Fosnaugh ..... 439/651
5,984,728 A * 11/1999 Chen et al. ..... 439/620.22
6,132,257 A * 10/2000 Wang et al. ..... 439/620.34
2007/0074058 A1* 3/2007 Wang ..... 713/323

* cited by examiner

*Primary Examiner*—James R. Harvey
(74) *Attorney, Agent, or Firm*—Pro-Techtor Int'l Services

(57) ABSTRACT

A multifunctional power jack comprises a main body, having a front part and a rear part with grooves, a front cover, a sensor protection circuit, an electrical noise suppression circuit, and a power indicator circuit, electrically connected with said sensor protection circuit and said electrical noise suppression circuit, so that supplied devices are protected from overload, electric noise is minimized and applied electric voltage is indicated.

5 Claims, 4 Drawing Sheets

MULTIFUNCTIONAL POWER JACK

BACKGROUND OF THE INVENTION

1. Field of the Invention

The present invention relates to a multifunctional power jack, particularly to a multifunctional power jack having a sensor protection circuit, an electrical noise suppression circuit and a power indicator circuit.

2. Description of Related Art

In modern life, everyone needs to use electricity, while the known way of how to obtain electric power is generally restricted to plugging into a power jack. Common people don't have an idea of design and structure of electrical supply. Particularly, as far as safety installations, fuses are relied on. Fuses cut off electric power if overload happens, thereby protecting electrical devices and preventing fire. However, today's quality of electrical supply is faulty, furthermore, occasionally spikes in drawn power occur, e.g., upon starting of an electric motor, in which case cutting off of power would be inconvenient. Therefore, nominal capacity of a given electrical device is hard to specify, which carries the risk of wrong assessments and even subsequent disasters.

Therefore, there is a need to improve on conventional power supplies at the point of power jacks.

SUMMARY OF THE INVENTION

An object of the present invention is to provide a multifunctional power jack having a sensor protection circuit.

Another object of the present invention is to provide a multifunctional power jack having an electrical noise suppression circuit.

A further object of the present invention is to provide a multifunctional power jack having a power indicator circuit.

The present invention can be more fully understood by reference to the following description and accompanying drawings.

DETAILED DESCRIPTION OF THE PREFERRED EMBODIMENTS

As shown in FIG. 1, the multifunctional power jack of the present invention comprises a main body 2 with a front part 21 and a rear part 22; a front cover 3; a sensor protection circuit 4; an electrical noise suppression circuit 5; and a power indicator circuit 6. In the following, a detailed explanation is given.

The front part 21 of the main body 2 has insertion holes 211, 212 and ground-connecting holes 213, 214. In middle positions, the front part 21 further has a button hole 215 and an indicator hole 216. Projections 217 are placed on a peripheral rear edge. The rear part 22 is placed behind the front part 21, having an elongated groove 221 for accommodating a circuit board 222 and a T-shaped groove 223 for taking in the sensor protection circuit 4, the electrical noise suppression circuit 5 and the power indicator circuit 6. Projections 224 at a front peripheral edge of the rear part 22 allow to snap together the front part 21 and the rear part 22. On a rear side of the rear part 22, connectors 23 are disposed for connecting electricity conduit wiring and connect ground wiring. As shown in FIG. 5, each connector 23 has a copper plate, shaped like the letter F, two plate springs, a plastics button and holes for inserting and pulling out wires and allowing access for fixing wires with a screwdriver. The connectors 23 are known art and do not need to be explained further.

The front cover 3 has several projections 31 serving to attach the front cover 3 to the main body 2 and holes 32 close to two opposite ends.

Referring to FIGS. 1 and 2, the sensor protection circuit 4 comprises a switching circuit 41 and a recuperate device 42 and is placed in the T-shaped groove 223. The switching circuit 41 has a U-shaped frame 411 into which a circular hole 412 is bored and, on a periphery thereof, circuit boards 413, 414. As shown in FIG. 2A, a bimetallic slice 415 is mounted on the circuit board 414 on one and, with an opposite end reaching to a power source terminal 416.

As shown in FIG. 2B, the recuperate device 42 has a reset button 421 and a spring 422. The reset button 421 passes through the circular hole 412, having a rear end that extends to the bimetallic slice 415 and a front end that, by the elasticity of the spring 422, extends through the buttonhole 215. The reset button 421 is fixed on the U-shaped frame 411.

Under regular operation, when electrical power is supplied, the bimetallic slice 415 and the circuit board 414 form a power supply circuit. Upon overload or a short circuit, the bimetallic slice 415 deforms due to a temperature rise and the power supply circuit is opened. After a cause of the overload or short circuit has been eliminated, the reset button is manually pressed and the power supply circuit is closed again. Alternatively, decreased temperature causes the bimetallic slice 415 to assume an original shape, so that the power supply circuit is automatically closed again.

Referring to FIGS. 1 and 3, the electrical noise suppression circuit 5 is connected with the sensor protection circuit 4 and the power indicator circuit 6. A thermal noise receiver (TNR) 51 is placed in the T-shaped groove 223, filtering noise from supplied electrical current and maintaining high quality of supplied electricity for safety of supplied electrical devices.

The power indicator circuit 6 is connected with the TNR 51 in parallel connection, comprising a resistor 61 and a lamp 62. The lamp 62 extends through the indicator hole 216, so as to be visible from outside, and is a fluorescent tube, a liquid crystal display or a light emitting diode. Electric voltage is indicated by the lamp 62, so that risk due to inadvertent exposure is minimized.

As shown in FIG. 4, the multifunctional power jack of the present invention is not larger than a conventional power jack, combining functions of power supply with protection from effects of short circuits, including fire and danger for life, as well as maintaining quality of electrical current.

The sensor protection circuit 4 has a switching circuit and a recuperate device. During normal operation, electric current stays below a threshold. Upon overload or a short circuit, electric current exceeds the threshold and is cut off. After eliminating the cause of overload or short circuit, flow of current is restored manually or automatically by the recuperate device.

Since during operation, a normal user does not know the quality of the supplied electric power, electric noise, e.g., caused by starting electric motors, may damage supplied devices. A TNR helps to minimize thermal noise and maintain quality of the supplied electric power.

Furthermore, a normal user who is not equipped with a voltage measuring device has no way to see if electric voltage is present or not. A power indicator circuit with a lamp helps to make applied electric voltage visible. Upon applied voltage, the lamp shines, and with no applied voltage, the lamp remains dark.

While the invention has been described with reference to preferred embodiments thereof, it is to be understood that modifications or variations may be easily made without departing from the spirit of this invention which is defined by the appended claims.

Figure 1:
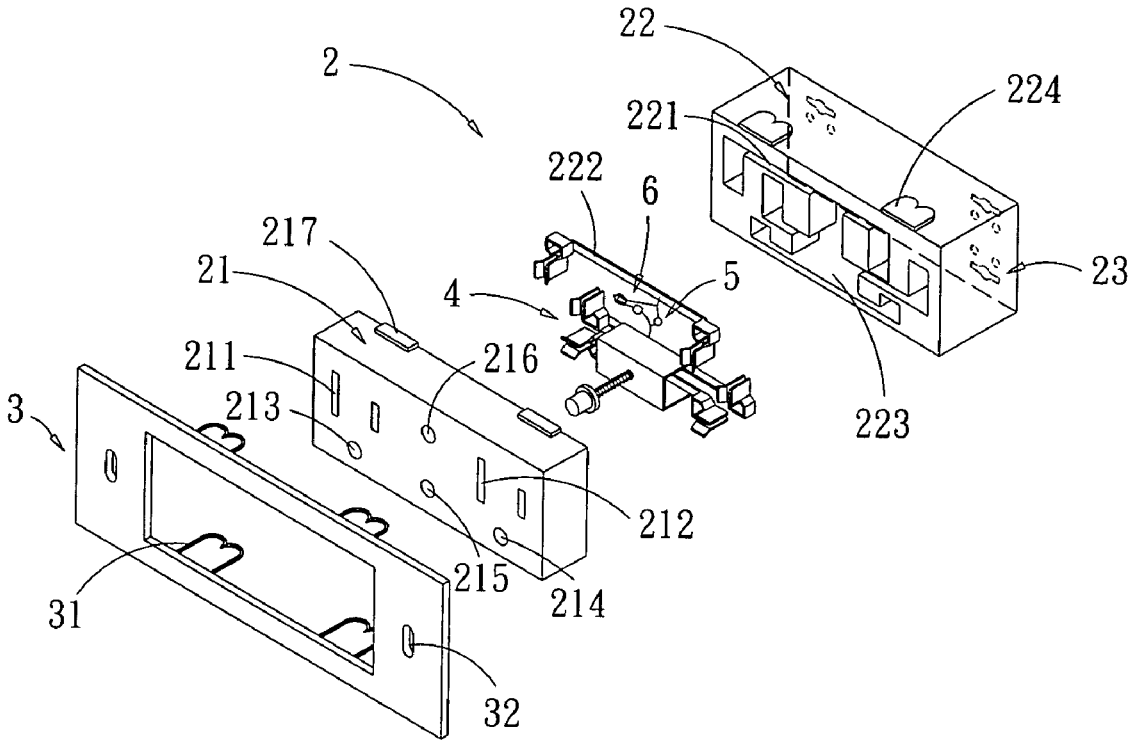
FIG. 1 is a perspective view of the multifunctional power jack of the present invention when disassembled.
Figure 2:
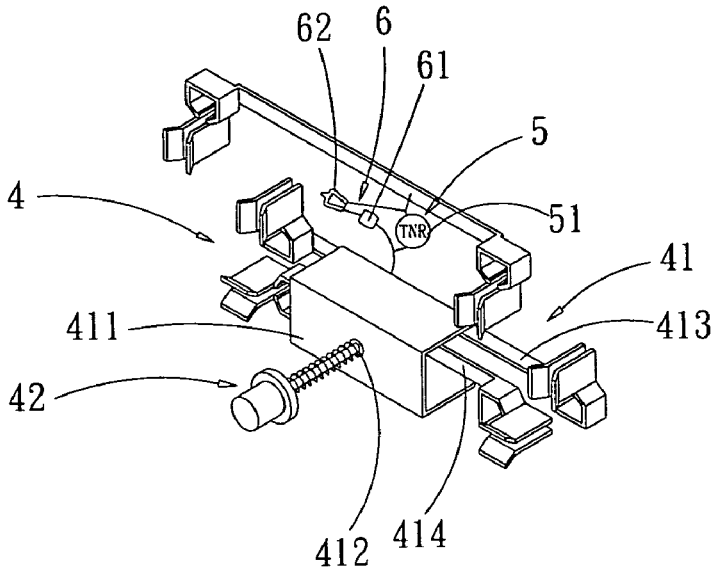
FIG. 2 is a perspective view of the sensor protection circuit, the electrical noise suppression circuit and the power indicator circuit of the present invention.
Figure 2A:
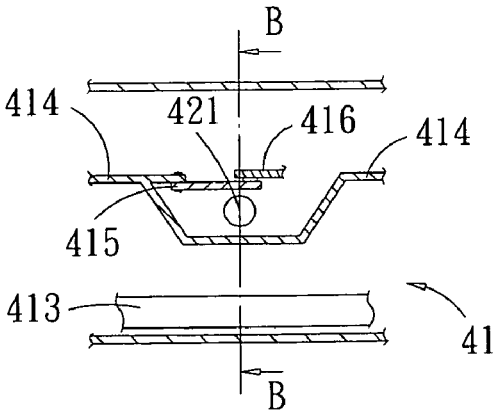
FIG. 2A is a sectional rear view of the sensor protection circuit of the present invention.
Figure 2B:
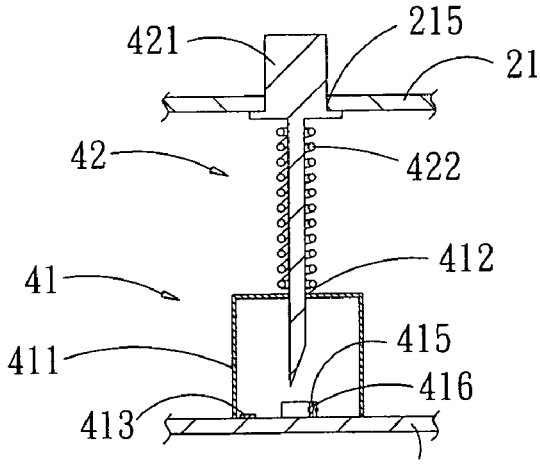
FIG. 2B is a sectional side view of the sensor protection circuit of the present invention.
Figure 3:
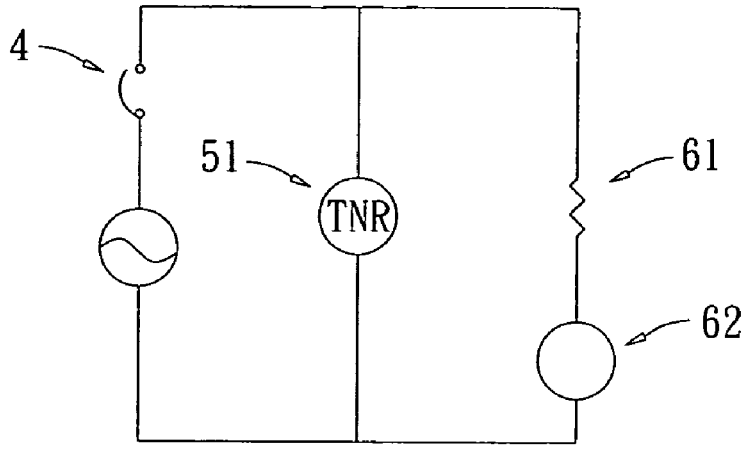
FIG. 3 is a circuit diagram of the electrical noise suppression circuit and the power indicator circuit of the present invention.
Figure 4:
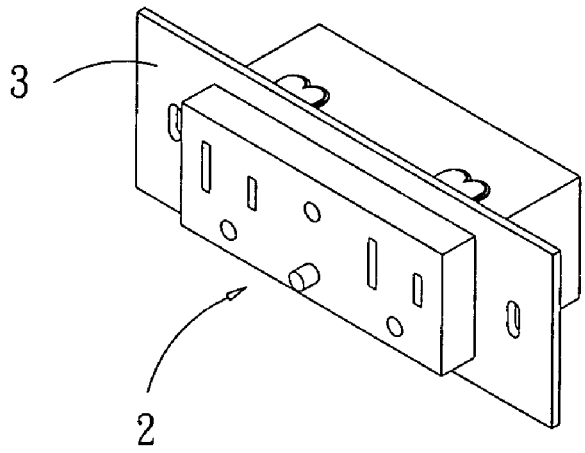
FIG. 4 is a perspective view of the multifunctional power jack of the present invention when assembled.
Figure 5:
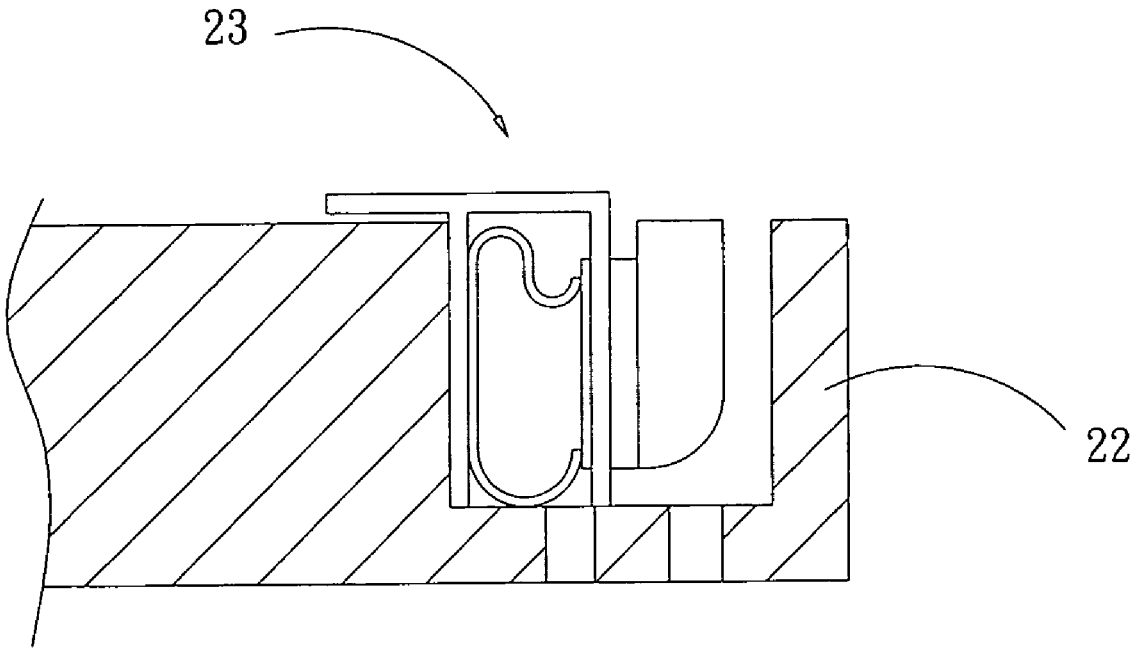
FIG. 5 is a sectional side view of one of the connectors of the present invention.

The invention claimed is:

1. A multifunctional power jack, comprising a main body, having a front part with insertion holes, ground-connecting holes and, on a rear periphery, projections, further having a rear part which is attached to said front part at a rear side thereof and has projections at a front periphery and grooves;

a front cover, set on said main body on a front side thereof and accessible from outside, having a button hole and an insertion hole;

a sensor protection circuit, having a switching circuit and a recuperative device;

an electrical noise suppression circuit, having an electrical noise suppression element; and a power indicator circuit, electrically connected with said sensor protection circuit and said electrical noise suppression circuit, having a resistor and a lamp which extends through an indicator hole of said cover;

wherein supplied devices are protected from overload, electric noise is minimized and applied electric voltage is indicated.

2. The multifunctional power jack according to claim 1, wherein said switching circuit of said sensor protection circuit further comprises a U-shaped frame with a circular hole and a periphery on which circuit boards and a bimetallic slice are mounted which connects said circuit boards and a power source terminal, and wherein said recuperative device of said sensor protection circuit further comprises a reset button, having a front end that extends through said button hole, pressed by a spring, and a rear end that passes through said circular hole and contacts said bimetallic slice, so that, if overload or a short circuit of a supplied device occurs, said bimetallic slice deforms due to increased temperature, cutting off supplied electrical power, and decreased temperature or manual pressing of said reset button restore power supply, achieving automatic or manual power restoring.

3. The multifunctional power jack according to claim 2, wherein said bimetallic slice connects said circuit boards and said power source terminal by having a first end fixed and a second end suspended.

4. The multifunctional power jack according to claim 1, wherein said electrical noise suppression element is a thermal noise receiver.

5. The multifunctional power jack according to claim 1, wherein said lamp is a fluorescent tube, a liquid crystal display or a light emitting diode, shining when electric voltage is supplied and remaining dark if no electric voltage is supplied.

* * * * *